US010266916B2

(12) United States Patent
Bae et al.

(10) Patent No.: US 10,266,916 B2
(45) Date of Patent: Apr. 23, 2019

(54) CRYSTAL GRAIN REFINER FOR MAGNESIUM ALLOY, CONTAINING ALUMINUM, A METHOD FOR PREPARING MAGNESIUM ALLOY, AND MAGNESIUM ALLOY MANUFACTURED BY SAME METHOD

(71) Applicant: KOREA INSTITUTE OF MACHINERY & MATERIALS, Daejeon (KR)

(72) Inventors: Jun-ho Bae, Gyeongsangnam-do (KR); Bong-sun You, Gyeongsangnam-do (KR); Young-min Kim, Gyeongsangnam-do (KR); Ha-sik Kim, Gyeongsangnam-do (KR); Chang-dong Lim, Seoul (KR); Byeong-gi Moon, Gyeongsangnam-do (KR); Sung-hyuk Park, Gyeongsangnam-do (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 147 days.

(21) Appl. No.: 15/124,844

(22) PCT Filed: Apr. 6, 2015

(86) PCT No.: PCT/KR2015/003405

§ 371 (c)(1),
(2) Date: Sep. 9, 2016

(87) PCT Pub. No.: WO2015/156549

PCT Pub. Date: Oct. 15, 2015

(65) Prior Publication Data

US 2017/0016089 A1 Jan. 19, 2017

(30) Foreign Application Priority Data

Apr. 10, 2014 (KR) ..... 10-2014-0042714
Apr. 10, 2014 (KR) ..... 10-2014-0042715

(51) Int. Cl.
*C22C 1/06* (2006.01)
*C22C 1/02* (2006.01)
(Continued)

(52) U.S. Cl.
CPC ..... *C22C 1/06* (2013.01); *B22D 1/00* (2013.01); *B22D 21/04* (2013.01); *C22C 1/02* (2013.01); *C22C 23/02* (2013.01)

(58) Field of Classification Search
CPC ..... B22D 21/04; C22C 23/02
See application file for complete search history.

(56) References Cited

U.S. PATENT DOCUMENTS 6,616,729 B2 * 9/2003 Motegi ..... C22C 1/02 148/420

FOREIGN PATENT DOCUMENTS

CN 101693969 A * 4/2010
JP 2001342528 A 12/2001
(Continued)

OTHER PUBLICATIONS

Kreiner et al, "The crystal structure of λ-Al4Mn", Journal of Alloys and Compounds 261, 1997, pp. 83-104.*

*Primary Examiner* — Ngoc-Yen Nguyen
(74) *Attorney, Agent, or Firm* — Stuart H. Mayer; Mayer & Williams PC

(57) ABSTRACT

A grain refiner for a magnesium alloy according to the present invention contains aluminum (Al) and manganese (Mn), and contains a compound of aluminum (Al) and manganese (Mn) in the microstructure thereof, wherein the grain refiner is composed of a structure in which, in the compound of aluminum (Al) and manganese (Mn), the area of the compound having an Al/Mn compositional (atomic) ratio of 4-4.5 is larger than the area of the compound having an Al/Mn compositional (atomic) ratio of 5.5-6.5. When the grain refiner is added to molten magnesium, crystal grains can be refined to 50-100 μm.

8 Claims, 7 Drawing Sheets

(51) Int. Cl.

| | |
|---|---|
| ***C22C 23/02*** | (2006.01) |
| ***B22D 21/04*** | (2006.01) |
| ***B22D 1/00*** | (2006.01) |

(56) References Cited

FOREIGN PATENT DOCUMENTS

| | | | |
|---|---|---|---|
| JP | 2003041331 | A | 2/2003 |
| KR | 100836599 | B1 | 6/2008 |
| KR | 101214939 | B1 | 12/2012 |

* cited by examiner

CRYSTAL GRAIN REFINER FOR MAGNESIUM ALLOY, CONTAINING ALUMINUM, A METHOD FOR PREPARING MAGNESIUM ALLOY, AND MAGNESIUM ALLOY MANUFACTURED BY SAME METHOD

TECHNICAL FIELD

The present invention relates to a grain refiner which may be used for the refinement of grains by being added in a casting process of a magnesium alloy, particularly a Mg—Al based alloy, and more particularly, to a refiner, which may be safely added by reducing the risk of fire in molten magnesium because the refiner may be added to the molten magnesium in the form of an alloy or liquid, different from a typical refiner in the form of powder, and may be economical and efficient because the refiner may also be easily used in commercial general foundry equipment, a method of manufacturing a magnesium alloy using the refiner, and a magnesium alloy manufactured by the method.

BACKGROUND ART

Magnesium, as a metal having a specific gravity of 1.74, is being in the spotlight as an aerospace material and an exterior material of electronic devices, because it is not only the lightest metal among metallic materials, but it also has excellent specific strength, dimensional stability, electromagnetic shielding, and heat dissipation properties. However, since general characteristics of magnesium in terms of strength and corrosion are not suitable for being used as a structural material, magnesium is being used in the form of alloys to which various elements are added.

Since most of the magnesium alloys having a hexagonal close packed (HCP) lattice structure has low ductility in comparison to conventional metallic materials having a body centered cubic (BCC) or face centered cubic (FCC) lattice structure, they are generally classified into a difficult processing material having low plastic workability. Thus, industrially used magnesium alloys are being used in the form of a cast instead of a forge.

As in common metals, a grain refiner added in a casting process of a magnesium alloy may provide various advantages such as an improvement in mechanical properties, a decrease in casting defects, suppression of segregation, an improvement in formability, and an improvement in surface properties.

For example, like an AZ-series magnesium alloy, as a magnesium (Mg)-aluminum (Al)-zinc (Zn)-based alloy having excellent corrosion resistance, and an AM-series magnesium alloy, as a magnesium (Mg)-aluminum (Al)-based alloy having excellent ductility, most of commercial magnesium alloys contains aluminum, wherein, as a grain refinement mechanism of the magnesium alloys containing aluminum, there currently are a heterogeneous nuclei theory and a carbon segregation theory.

Among these theories, the heterogeneous nuclei theory is a theory in which aluminum and carbon in a melt are combined to form a carbide by adding various inorganic compounds or gas containing carbon to the melt and particles of the carbide act as nucleation particles in a magnesium matrix during solidification of the melt to refine grains. Also, the carbon segregation theory is a theory in which a carbon element added to a melt inhibits grain growth by being segregated at a solid-liquid interface as initially solidified grains grow and thus, grains are refined.

As a typical method of refining a magnesium alloy based on the above theories, various methods, such as a superheating method in which a melt is superheated above a predetermined temperature, cooled to an injection temperature, and then injected, the Elfinal process in which ferric chloride ($FeCl_3$) is added to a melt, a zirconium addition method in which zirconium (Zr) is added to a melt, and a carbon addition method, and refiners suitable for the methods have been developed.

The superheating method is a process in which a melt prepared by melting a magnesium alloy is superheated to a temperature of 180° C. to 300° C. or more, rapidly cooled to a casting temperature, and then injected, wherein there are limitations in that equipment costs and manufacturing costs are increased due to heat and rapid cooling processes, energy efficiency is reduced, and it is difficult to apply the method to large casting and continuous casting process.

The Elfinal process was developed in Germany in 1942 and is a method of refining grains by adding ferric chloride ($FeCl_3$) to a melt near 740° C. to 780° C., but the process is disadvantageous in that, since iron (Fe) is added to an alloy, corrosion resistance of the alloy is reduced and chlorine gas harmful to the human body is generated.

The zirconium addition method, as a method of refining magnesium grains by adding 0.5 wt % to 1.0 wt % of zirconium, is currently widely used, but since a refinement effect disappears in a magnesium alloy containing aluminum and manganese alloying elements due to a reaction with these elements, the method may be difficult to be used, and the method may be difficult to be commercialized because a commercial magnesium alloy contains large amounts of these elements.

The carbon addition method is divided into a method of directly adding fine carbon powder to a melt and a method of adding an inorganic compound containing carbon. With respect to the carbon addition method, since there is no need to increase the temperature of the melt to a high temperature in comparison to the superheating method and the method is good in terms of economy, it is known as the most important refinement method for magnesium (Mg)-aluminum (Al)-based alloys.

However, the method of directly adding carbon powder in the above-described carbon addition method is a method of directly adding carbon black or fine carbon powder containing carbon to the melt, wherein since the carbon powder is not uniformly dispersed during the addition and most of the carbon powder may float on the melt to reduce refining efficiency, the method of adding the inorganic compound to the melt is more widely used.

As related art relating to a grain refiner of a magnesium alloy, Korean Patent No. 0836599 discloses a grain refiner of a magnesium alloy casting material and a refinement method. Specifically, the grain refinement method of a magnesium alloy casting material, which includes a refiner addition process, in which an aluminum-containing magnesium alloy is melted and magnesium carbonate ($MgCO_3$) powder is then added in an amount of 0.5 wt % to 5.0 wt % based on an amount of the melt at a refiner addition temperature of 650° C. to 760° C., and a casting process, in which the melt is maintained for 5 minutes or more after the refiner addition process and is then cast, is disclosed. However, in a case in which the magnesium carbonate powder is added to the molten magnesium according to the refinement method, since the highly reactive magnesium carbonate is used in the form of powder having a high surface area, a reaction may vigorously proceed, the refiner may not be uniformly mixed in a lower portion of the melt, and the vigorous reaction may also cause a problem such as explosion.

Also, Korean Patent Application Laid-Open Publication No. 2009-0036239 discloses a grain refinement method of a magnesium alloy, and, specifically, the grain refinement method of a magnesium alloy, which includes the steps of preparing a molten magnesium alloy by melting a magnesium alloy using an electric furnace in an argon atmosphere, adding hexachloroethane ($C_2Cl_6$) to the molten magnesium alloy at a temperature of 780° C., and maintaining a mixed melt of the magnesium alloy and the hexachloroethane for 20 minutes to completely decompose the hexachloroethane, is disclosed.

However, in a case in which the hexachloroethane is added to the molten magnesium alloy according to the refinement method, fine grains may be obtained, but, when the hexachloroethane is added to the melt, a large amount of chlorine gas, which is fatal to the human body and corrodes metallic materials, may be generated.

Furthermore, Korean Patent No. 1214939 discloses a method of manufacturing a magnesium alloy, and, specifically, the method of manufacturing a magnesium alloy, which includes the steps of preparing a molten magnesium alloy by applying a protective gas to a magnesium alloy and heating the magnesium alloy to a melting temperature of the magnesium alloy to melt the magnesium alloy, adding a magnesium alloy grain refiner in the form of powder, pellets, rods, or wires to the molten magnesium alloy, and casting the molten magnesium alloy to form a fine-grained magnesium alloy casting material, is disclosed.

However, in a case in which the powder is directly added according to the method of manufacturing a magnesium alloy, a lower yield may be obtained in comparison to the amount of the added powder due to a phenomenon, in which the powder is discharged onto a surface or floats to the surface of the melt, and, when the refiner is added in the form of the pellets, the pellets are not completely decomposed, but partially compressed inclusion agglomerates may remain in the melt. Also, since manganese carbonate, as a carbonate-based material, is highly reactive regardless of the shape of the refiner, the melt boils due to carbon dioxide gas generated during decomposition when the manganese carbonate is directly added to the molten magnesium, and thus, there may be a risk of fire and a risk of oxidation of the surface of the molten magnesium.

DISCLOSURE OF THE INVENTION

Technical Problem

The present invention provides a grain refiner, which may be prepared at a lower cost while being safer than a typical refiner and may efficiently perform refinement, a method of manufacturing a magnesium alloy using the refiner, and a magnesium alloy refined by this method.

Technical Solution

According to an aspect of the present invention, there is provided a refiner for a magnesium alloy including: aluminum (Al) and manganese (Mn); and a compound of aluminum (Al) and manganese (Mn) in a microstructure, wherein, in the compound of Al and Mn, an area of a compound having an Al/Mn compositional (atomic) ratio of 4 to 4.5 is greater than an area of a compound having an Al/Mn compositional (atomic) ratio of 5.5 to 6.5.

According to another aspect of the present invention, there is provided a method of manufacturing a magnesium alloy including: preparing a molten magnesium alloy by applying a protective gas to a magnesium alloy and heating the magnesium alloy to a melting temperature of the magnesium alloy to melt the magnesium alloy; adding the refiner to the molten magnesium alloy and maintaining and stirring for 5 minutes to 2 hours; and casting the molten magnesium alloy having the refiner added thereto to manufacture a magnesium alloy casting material.

According to another aspect of the present invention, there is provided a magnesium alloy manufactured according to the method of manufacturing a magnesium alloy, wherein the magnesium alloy has a grain diameter of 50 μm to 100 μm.

Advantageous Effects

Since a refiner according to the present invention is added as a solid phase or liquid phase in the form of a master alloy different from a typical refiner in the form of particles, side effects, such as gas generation due to a reaction of a melt with refiner powder, melt ignition, and oxidation, may be removed.

Also, since the refiner may be added in the form of non-powder, various processes typically performed to uniformly distribute the refiner powder in the melt may be omitted, and thus, processing costs may be significantly reduced.

Since the refiner according to the present invention may be prepared by a method, in which a predetermined amount of carbon dioxide is injected into a melt composed of aluminum and a predetermined amount of manganese for a predetermined period of time and the melt is then cast, and the injection of the carbon dioxide may be performed by typical gas bubbling equipment, additional processing costs or equipment may be hardly necessary, and thus, it is economical.

Since the refiner according to the present invention is prepared using aluminum and manganese, elements that are most widely used in commercial magnesium alloys, and using inexpensive carbon dioxide gas, the refiner may be prepared at a lower cost in term of raw materials than a typical refiner.

Furthermore, since the refiner according to the present invention may be added in the form of an alloy, processing is not limited and a resulting degree of freedom in shape is high, and thus, the refiner may be easily used in various casting processes.

MODE FOR CARRYING OUT THE INVENTION

Figure 1:
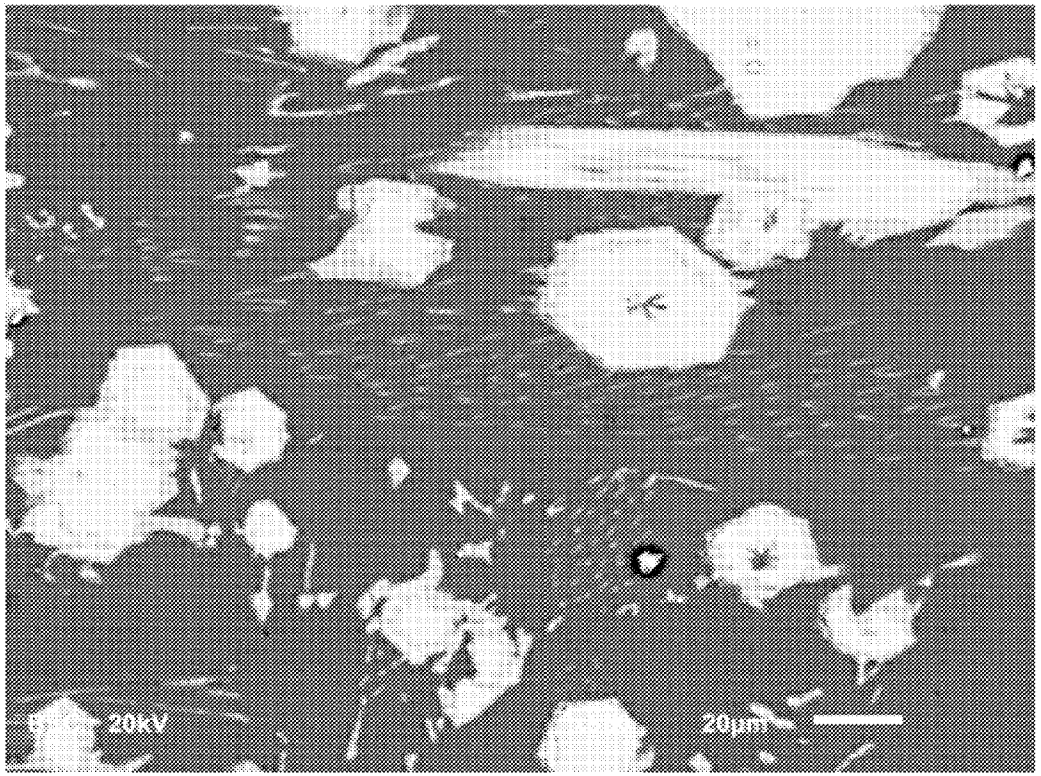
FIG. 1 is an image showing a microstructure of a refiner prepared according to Example 1 of the present invention.

Hereinafter, embodiments of the present invention will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

The present inventors found that a refinement effect of a magnesium alloy is excellent when a second phase having a predetermined compositional (atomic) ratio is formed in a microstructure of an alloy which is formed of an alloy only containing main alloying elements included in a magnesium alloy, thereby leading to the completion of the present invention.

A refiner for a magnesium alloy according to the present invention includes aluminum (Al) and manganese (Mn) and includes a compound of aluminum (Al) and manganese (Mn) in a microstructure, wherein, in the compound of Al and Mn, an area of a compound having an Al/Mn compositional (atomic) ratio of 4 to 4.5 is greater than an area of a compound having an Al/Mn compositional (atomic) ratio of 5.5 to 6.5.

A second phase, such as $Al_4Mn$, $Al_6Mn$, $Al_{99}Mn_{23}$, $Al_{12}Mn$, $Al_{11}Mn_4$, and $Al_8Mn_5$, may be formed in an aluminum alloy including manganese, wherein, in terms of refining efficiency of the magnesium alloy, an area fraction of the compound having an Al/Mn compositional (atomic) ratio of 4 to 4.5 may be 50% or more, for example, 70% or more, based on a total area of the Al—Mn compound.

The microstructure may include a compound phase of aluminum (Al) and manganese (Mn), in which at least one of a flat interface and an acicular interface is formed.

A matrix of the microstructure is composed of aluminum.

The refiner may be formed of an aluminum alloy which includes 7 wt % to 15 wt % of manganese, and aluminum as well as unavoidable impurities as a remainder.

In a case in which an amount of the manganese is less than 7 wt %, since the refining efficiency of the magnesium alloy is insufficient, it is desirable to add the manganese in an amount of 7 wt % or more. Also, the more the amount of the manganese in aluminum is, the higher the melting temperature is, wherein, when the amount of the manganese added is greater than 15 wt %, the refining efficiency of the magnesium alloy is increased. However, the refiner may not only be difficult to be melted in a commercial large resistance furnace due to its high melting point, but also there is no way to avoid an increase in a temperature of molten magnesium when the refiner is added to the molten magnesium. Thus, since a risk of fire and oxidation is high during the processing of the molten magnesium, the amount of the manganese may be 15 wt % or less, i.e., a composition of the manganese which may be melted in a temperature range of 600° C. to 780° C., a typical casting temperature range.

Also, the refiner may further include 1 wt % or less of carbon (C).

The unavoidable impurities are components which are derived from raw materials or equipment during a process of manufacturing an aluminum-manganese alloy, wherein the unavoidable impurities may be included in a small amount of 1 wt % or less, within a range that does not affect the refinement of magnesium. The unavoidable impurities may be included in an amount of 0.1 wt % or less, for example, 0.01 wt % or less.

In a case in which an area fraction occupied by the aluminum-manganese compound phase in the microstructure of the refiner is less than 5%, since the refining efficiency of the magnesium alloy is insufficient, it is desirable to maintain the area fraction at 5% or more, for example, 10% to 30%.

In this case, the area fraction (%) of the aluminum-manganese compound phase denotes a ratio of an area occupied by the compound phase to a total area of the refiner in a scanning electron microscope image at 300 times magnification.

The refiner according to the present invention is characterized in that the generation of the compound having an Al/Mn compositional (atomic) ratio of 5.5 to 6.5 among the generated second phases of aluminum and manganese is promoted by injecting carbon into a melt of an alloy including aluminum (Al) and manganese (Mn) for 30 seconds to 120 seconds, thus increasing an area fraction occupied by the compound having an Al/Mn compositional (atomic) ratio of 5.5 to 6.5 in a total area of the second phases in the microstructure of the refiner.

Since the refining efficiency is maximized when the area fraction occupied by the compound having an Al/Mn compositional (atomic) ratio of 5.5 to 6.5 in the total area of the second phases in the microstructure of the refiner is 50% or more, for example, 70% or more, it is desirable to control the injection of the carbon to increase the area fraction occupied by the compound having an Al/Mn compositional (atomic) ratio of 5.5 to 6.5.

The carbon injection may be performed by injecting carbon dioxide, but the injection of carbon in other forms is not limited as long as the control of the microstructure as in the present invention is possible.

In a case in which a carbon injection time is less than 30 seconds or greater than 120 seconds, since it is not easy to form the above-described compound phase of aluminum and manganese, it is desirable to maintain the carbon injection time at 30 seconds to 120 seconds.

Also, a method of manufacturing a magnesium alloy using the refiner according to the present invention includes preparing a molten magnesium alloy by applying a protective gas to a magnesium alloy and heating the magnesium alloy to a melting temperature of the magnesium alloy to melt the magnesium alloy, adding the refiner to the molten magnesium alloy and maintaining and stirring for 5 minutes to 2 hours, and casting the molten magnesium alloy having the refiner added thereto to manufacture a magnesium alloy casting material.

As a magnesium alloy in which the refiner of the present invention may be used, various magnesium alloys for casting and processing among most of magnesium alloys including aluminum, such as AZ-series alloys and AM-series alloys, may be used, and, for example, a magnesium alloy including aluminum as well as a trace of manganese may be used.

Furthermore, a temperature of the molten magnesium alloy may be maintained at 600° C. to 780° C. The reason for this is that, in a case in which the temperature of the melt is less than 600° C., the molten state is not maintained, and in a case in which the temperature of the melt is greater than 780° C., energy costs are not only high, but also the reactivity of the magnesium alloy may be increased to oxidize magnesium or impurities may be included.

The protective gas is used to block a reaction of magnesium with oxygen present in the atmosphere and form a stable protective coating layer on the surface of the melt, wherein a mixture of $SF_6$ and $CO_2$, for example, may be used, but the present invention is not limited thereto.

When the refiner according to the present invention is added to the molten magnesium, the refiner may be processed in various forms, such as an ingot or long rod and a plate, according to industrial field equipment and casting process, and added, and the refiner may also be added as a molten liquid phase via various routes.

After the addition of the aluminum-manganese refiner alloy prepared in the present invention, holding time may be changed to increase the refining efficiency. Also, it is desirable to continuously stir the melt during the holding time. In a case in which the holding time after the addition is short, less than 5 minutes, the refining efficiency is not sufficient, and, in a case in which the holding time is increased to 2 hours or more, since oxide inclusions on the surface of the melt are introduced into the melt to reduce the cleanliness of the melt, the melt may be held and/or stirred for 5 minutes to 2 hours.

The molten magnesium having the aluminum-manganese refiner alloy added thereto may be finally manufactured into a magnesium alloy by various casting methods such as casting using mold and sand mold, low-pressure casting, continuous casting, strip casting, precision casting, and die casting.

The magnesium alloy manufactured according to the present invention is manufactured by using the carbon-injected aluminum-manganese refiner, wherein the magnesium alloy may have a grain diameter of 50 μm to 100 μm which is significantly smaller than a grain diameter before the refinement. Accordingly, the magnesium alloy may exhibit improved mechanical properties and processability. Also, since the mechanical properties and processability are improved, the magnesium alloy according to the present invention may be widely used in transportation equipment, electronic products, and sports and leisure goods.

Hereinafter, the present invention will be described in more detail based on preferred examples of the present invention and comparative examples.

Example 1

Carbon dioxide was injected into molten aluminum including 10 wt % of manganese for 30 seconds at 800° C. and the molten aluminum was then cast to prepare a refiner.

Figure 2:
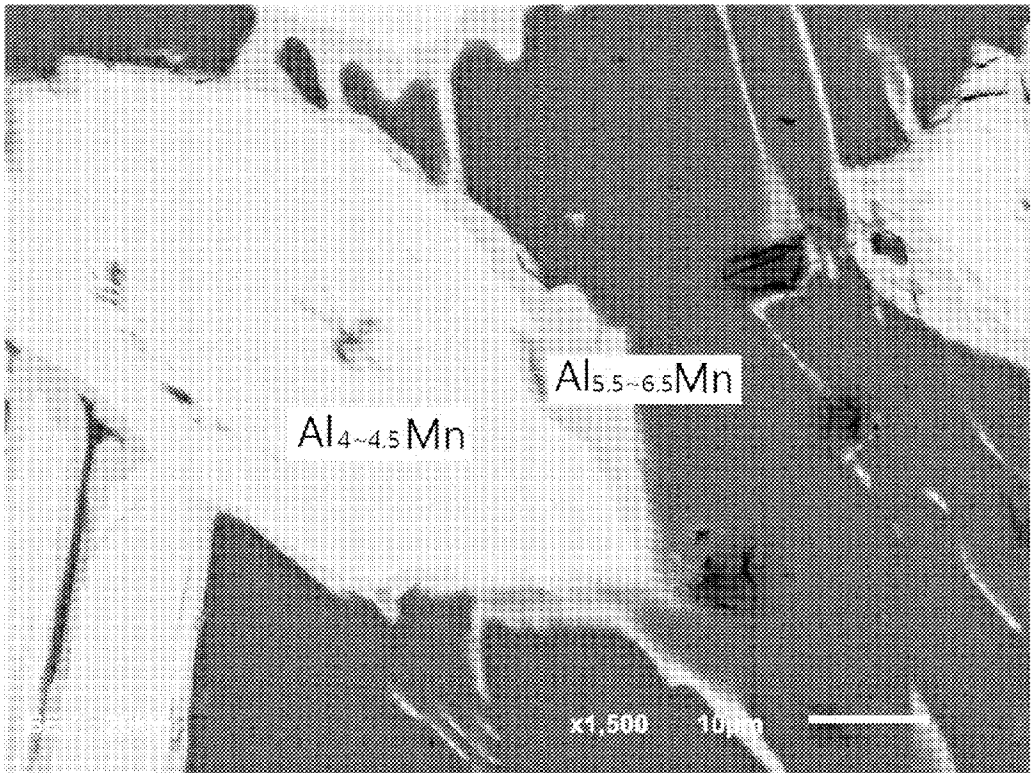
FIG. 2 is a magnified view of the microstructure prepared according to Example 1 of the present invention.

FIG. 1 is an image showing a microstructure of the refiner prepared according to Example 1 of the present invention, and FIG. 2 is a magnified view of the microstructure of Example 1. As illustrated in FIG. 1, the microstructure of the refiner according to Example 1 of the present invention was composed of an angular-shaped second phase in the form of particles in a matrix phase (aluminum). When the second phase in the form of particles was magnified, it was observed that a phase represented as a bright color accounted for most of the second phase and a relatively dark gray phase was partially formed therearound as illustrated in FIG. 2.

As a result of the composition analysis of the bright portion and gray portion of the second phase, it was confirmed that the bright portion had a composition of $Al_{4\text{-}4.5}Mn$, the gray portion had a composition of $Al_{5.5\text{-}6.5}Mn$, and an area fraction occupied by the bright portion in the second phase exceeded 70%.

Also, in the microstructure of the refiner prepared according to Example 1 of the present invention, a second phase having both flat portion and acicular portion at a boundary with a matrix was partially observed.

After an AZ80 magnesium alloy was melted at 720° C., the refiner prepared according to the above-described method was added in an amount of 3 wt % based on a total weight of a molten magnesium alloy while maintaining a melt temperature at 720° C. After the addition of the refiner, the melt was maintained for 30 minutes to allow the refiner to be completely melted in the melt. Thereafter, a magnesium alloy was manufactured by casting the melt into a die mold preheated to 200° C.

Example 2

A refiner and a magnesium alloy were manufactured in the same manner as in Example 1 except that holding and stirring time after the addition of the refiner was increased to 60 minutes.

As a result of analyzing a microstructure of the refiner, similar to Example 1, an aluminum-manganese second phase had an angular shape and was composed of phases of a bright portion having a composition of $Al_{4\text{-}4.5}Mn$ and a gray portion having a composition of $Al_{5.5\text{-}6.5}Mn$ therearound, wherein an area fraction occupied by the bright portion in the second phase exceeded 70%.

Also, similar to Example 1 of the present invention, a second phase having both flat portion and acicular portion at a boundary with a matrix was partially observed in the microstructure of the manufactured refiner.

Example 3

A refiner and a magnesium alloy were manufactured in the same manner as in Example 1 except that holding and stirring time after the addition of the refiner was increased to 120 minutes.

As a result of analyzing a microstructure of the refiner, similar to Example 1, an aluminum-manganese second phase had an angular shape and was composed of phases of a bright portion having a composition of $Al_{4\text{-}4.5}Mn$ and a gray portion having a composition of $Al_{5.5\text{-}6.5}Mn$ therearound, wherein an area fraction occupied by the bright portion in the second phase exceeded 70%.

Also, similar to Example 1 of the present invention, a second phase having both flat portion and acicular portion at a boundary with a matrix was partially observed in the microstructure of the manufactured refiner.

Example 4

Carbon dioxide was injected into molten aluminum including 15 wt % of manganese for 60 seconds at 900° C. and the molten aluminum was then cast to prepare a refiner.

Figure 3:
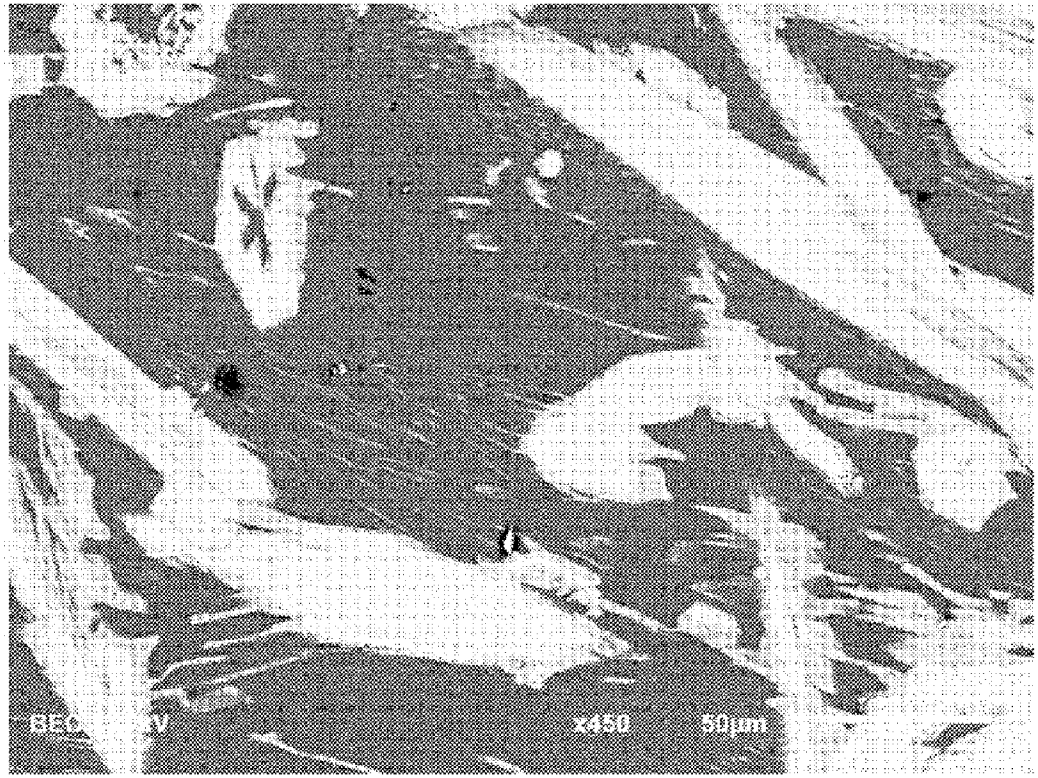
FIG. 3 is an image showing a microstructure of a refiner prepared according to Example 4 of the present invention.

As a result of analyzing a microstructure of the refiner thus prepared, similar to the microstructure of the refiner according to Example 2 and the microstructure of the refiner according to Example 1 of the present invention, it was confirmed that an angular-shaped second phase in the form of particles was formed in a matrix phase (aluminum) and most of the second phase was composed of a phase represented as a bright color and a relatively dark gray phase partially formed therearound as illustrated in FIG. 3, wherein the bright phase had a composition of $Al_{4\text{-}4.5}Mn$, the gray phase had a composition of $Al_{5.5\text{-}6.5}Mn$, and an area fraction occupied by the bright portion in the second phase exceeded 70%. Also, similar to Example 1 of the present invention, a plurality of second phases having both flat portion and acicular portion at a boundary with a matrix was observed in the microstructure of the prepared refiner. That is, the microstructure of the refiner according to Example 4 was similar to the microstructures of Examples 1 to 3.

After an AZ80 magnesium alloy was melted at 720° C., the refiner thus prepared was added in an amount of 2 wt % based on a total weight of a molten magnesium alloy while maintaining a melt temperature at 720° C. After the addition of the refiner, the melt was maintained for 5 minutes to allow the refiner to be completely melted in the melt. Thereafter, a magnesium alloy was manufactured by casting the melt into a die mold preheated to 200° C.

Magnesium alloys were manufactured as follows, in order to compare with the refiners and magnesium alloys manufactured according to Examples 1 to 4 of the present invention.

Comparative Example 1

AZ80, as a commercial magnesium alloy, was melted and then cast without the addition of a refiner.

Comparative Example 2

Carbon dioxide was injected into molten aluminum, to which manganese was not added, for 30 seconds at 800° C. to prepare a refiner.

After an AZ80 magnesium alloy was melted at 720° C., the refiner prepared according to the above-described method was added in an amount of 8 wt % based on a total weight of a molten magnesium alloy while maintaining a melt temperature at 720° C. After the addition of the refiner, the melt was maintained for 5 minutes to allow the refiner to be completely melted in the melt. Thereafter, a magnesium alloy was manufactured by casting the melt into a die mold preheated to 200° C.

Comparative Example 3

A refiner and a magnesium alloy were manufactured in the same manner as in Comparative Example 2 except that the refiner was prepared by injecting carbon dioxide into molten aluminum, to which manganese was not added, for 120 seconds at 800° C.

Comparative Example 4

Carbon dioxide was injected into molten aluminum including 5 wt % of manganese for 120 seconds at 800° C. and the molten aluminum was then cast to prepare a refiner.

Figure 4:
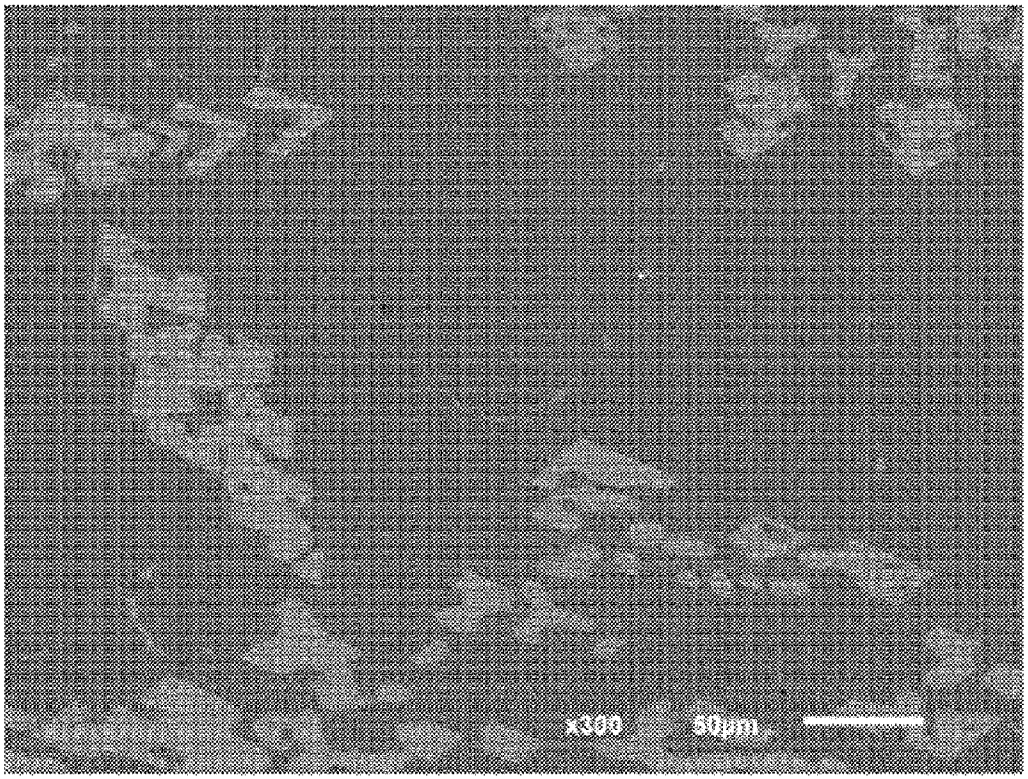
FIG. 4 is an image showing a microstructure of a refiner prepared according to Comparative Example 4.

As a result of analyzing a microstructure of the refiner prepared according to Comparative Example 4, as illustrated in FIG. 4, an aluminum-manganese compound second phase was formed to have an angular and flat shape in the refiner prepared according to Comparative Example 4. That is, the second phase having both flat portion and acicular portion at the boundary with the matrix, as in Examples 1 to 4 of the present invention, was not observed at all. Also, a bright phase having a composition of $Al_{4-4.5}Mn$ was hardly observed and the refiner was only composed of a gray phase having a composition of $Al_{5.5-6.5}Mn$. Thus, it may be understood that an area fraction occupied by the bright phase in the second phase was nearly 0%.

After an AZ80 magnesium alloy was melted at 720° C., the refiner prepared as described above was added in an amount of 6 wt % based on a total weight of a molten magnesium alloy while maintaining a melt temperature at 720° C. After the addition of the refiner, the melt was maintained for 30 minutes to allow the refiner to be completely melted in the melt. Thereafter, a magnesium alloy was manufactured by casting the melt into a die mold preheated to 200° C.

Comparative Example 5

Carbon dioxide was injected into molten aluminum including 15 wt % of manganese for 300 seconds at 900° C. and the molten aluminum was then cast to prepare a refiner.

Figure 5:
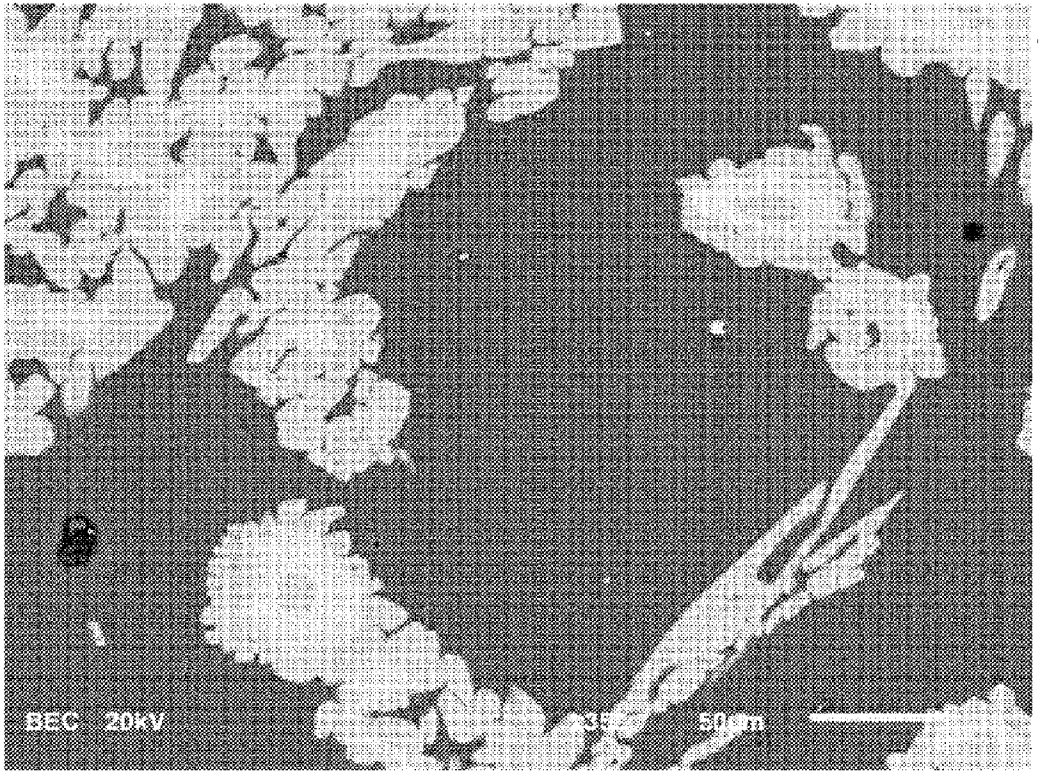
FIG. 5 is an image showing a microstructure of a refiner prepared according to Comparative Example 5.
Figure 6:
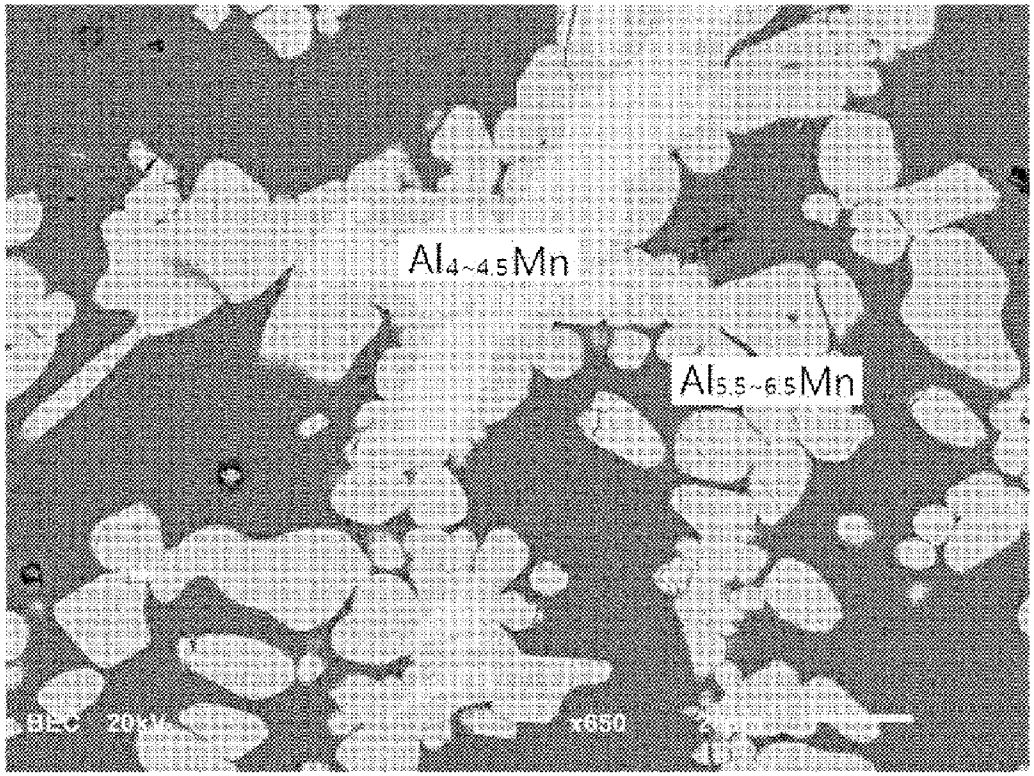
FIG. 6 is a magnified view of the microstructure of the refiner prepared according to Comparative Example 5; and (a) of FIG. 7 is a microstructural image of an AZ80 alloy which is refined using the refiner prepared according to Example 1 of the present invention, and (b) of FIG. 7 is a microstructural image of a commercial AZ80 alloy (Comparative Example 1).

As a result of analyzing a microstructure of the refiner thus prepared, as illustrated in FIGS. 5 and 6, an aluminum-manganese compound second phase was formed to mainly have a round and curved boundary in the refiner prepared according to Comparative Example 5, and the second phase having both flat portion and acicular portion at the boundary with the matrix, as in Examples 1 to 4 of the present invention, was not observed at all. In particular, since an area of a bright phase having a composition of $Al_{4-4.5}Mn$ was smaller than an area of a gray phase having a composition of $Al_{5.5-6.5}Mn$, it may be understood that an area fraction occupied by the bright phase in the second phase was less than 50%.

After an AZ80 magnesium alloy was melted at 720° C., the refiner thus prepared was added in an amount of 2 wt % based on a total weight of a molten magnesium alloy while maintaining a melt temperature at 720° C. After the addition of the refiner, the melt was maintained for 5 minutes to allow the refiner to be completely melted in the melt. Thereafter, a magnesium alloy was manufactured by casting the melt into a die mold preheated to 200° C.

The following Table 1 summarizes manufacturing conditions of the refiners and magnesium alloys manufactured according to the examples and comparative examples, and grain diameters of the manufactured magnesium alloys.

TABLE 1

| | $CO_2$ treatment | | Amount of | Shape of | Area fraction (%) of | Holding | | Grain | |
|---|---|---|---|---|---|---|---|---|---|
| Refiner composition | Temperature (° C.) | Time (seconds) | refiner added (wt %) | Al—Mn compound | $Al_{4-4.5}Mn$ in second phase | time (minutes) | Mg alloy composition | diameter (μm) | Remarks |
| — | — | — | — | — | — | — | Commercial AZ80 | 280 | Comparative Example 1 |
| Al | 800 | 30 | 8 | — | | 5 | AZ80 (Mg—8Al—0.5Zn—0.3Mn) | 340 | Comparative Example 2 |
| | 800 | 120 | 8 | — | | 5 | | 310 | Comparative Example 3 |

TABLE 1-continued

| Refiner composition | $CO_2$ treatment Temperature (° C.) | $CO_2$ treatment Time (seconds) | Amount of refiner added (wt %) | Shape of Al—Mn compound | Area fraction (%) of $Al_{4-4.5}Mn$ in second phase | Holding time (minutes) | Mg alloy composition | Grain diameter (μm) | Remarks |
|---|---|---|---|---|---|---|---|---|---|
| Al—5Mn | 800 | 120 | 6 | No acicular shape | Nearly 0% | 30 | | 190 | Comparative Example 4 |
| Al—10Mn | 800 | 30 | 3 | Acicular shape present | Above 70% | 30 | | 107 | Example 1 |
| | 800 | 30 | 3 | Acicular shape present | Above 70% | 60 | | 85 | Example 2 |
| | 800 | 30 | 3 | Acicular shape present | Above 70% | 120 | | 75 | Example 3 |
| Al—15Mn | 900 | 60 | 2 | Acicular shape present | Above 70% | 5 | | 53 | Example 4 |
| | 900 | 300 | 2 | No acicular shape | Less than 50% | 5 | | 170 | Example 5 |

Microstructure of Refiner

In an aluminum alloy including manganese, an area fraction of a second phase, as a compound of aluminum and manganese, is basically increased as the amount of the manganese is increased. However, a ratio of a phase occupied by a specific composition in the generated second phase indicates a significant difference according to an injection treatment time of carbon dioxide that is injected into molten aluminum-manganese.

As confirmed in FIGS. 1 to 3 and the microstructures of the refiners prepared according to Examples 1 to 4 of the present invention, an angular-shaped second phase in the form of particles was formed in a matrix phase (aluminum) in the microstructures of the refiners according to Examples 1 to 4 of the present invention, and a second phase having both flat surface and acicular surface at a boundary with a matrix was observed. Also, a phase represented as a bright color and having a composition of $Al_{4-4.5}Mn$ accounted for most of the observed second phase and a relatively dark gray phase having a composition of $Al_{5.5-6.5}Mn$ was partially formed therearound, wherein an area fraction occupied by the bright phase in the total second phase exceeded 70%.

In contrast, with respect to the shapes of the generated aluminum-manganese compound second phases of Comparative Examples 4 and 5, although the second phases of Comparative Examples 4 and 5 included manganese, Example 4 only had a flat and straight boundary and Example 5 mainly had a round and curved boundary. Since an area of the bright phase having a composition of $Al_{4-4.5}Mn$ was smaller than an area of the gray phase having a composition of $Al_{5.5-6.5}Mn$, an area fraction occupied by the bright phase in the second phase was less than 50%, and such a difference in the microstructures was related to a difference in refinement effect.

Figure 7:
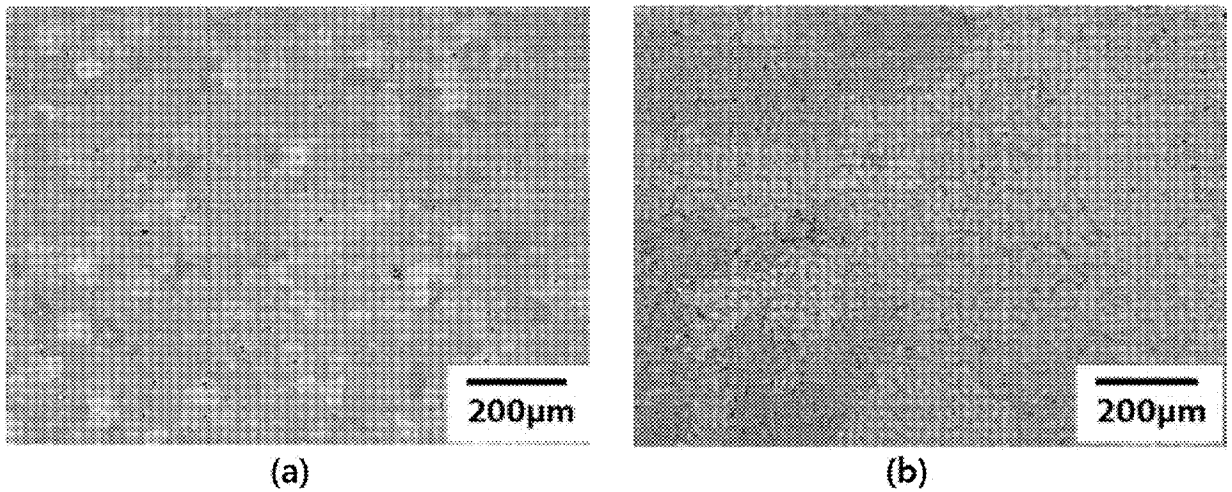

Magnesium Alloy Microstructure (a) of FIG. 7 is a microstructural image of an AZ80 alloy which is refined using the refiner prepared according to Example 1 of the present invention, and (b) of FIG. 7 is a microstructural image of a commercial AZ80 alloy (Comparative Example 1).

As illustrated in FIG. 7, it may be understood that considerable grain refinement was possible when the refiner according to Example 1 of the present invention was added.

As illustrated in Table 1, grain diameters of the magnesium alloys manufactured by using the refiners according to Examples 1 to 4 of the present invention were 107 μm or less and, with respect to Examples 2 to 4, the grain diameters were 90 μm or less. Thus, it may be understood that considerable refinement was obtained.

In contrast, with respect to Comparative Examples 2 and 3 in which manganese was not added and the carbon dioxide injection treatment was only performed, grain diameters of the magnesium alloys after the refinement were at a level of about 300 μm and thus, there was substantially no refinement effect.

Also, with respect to Comparative Example 4 in which manganese was added in an amount of 5 wt % and carbon dioxide was injected, a grain diameter tended to decrease in comparison to Comparative Examples 1 to 3, but the grain diameter was at a level of 190 μm and the refinement effect was not large enough to meet the requirements of the industry.

Furthermore, with respect to Comparative Example 5 in which manganese was added in an amount of 15 wt % and carbon dioxide was injected for 300 seconds, a grain diameter also tended to decrease in comparison to Comparative Examples 1 to 3, but the grain diameter was at a level of 170 μm and the refinement effect was also not large enough to meet the requirements of the industry.

When Comparative Examples 4 and 5 were compared with Examples 1 to 4 of the present invention, there was a difference in the grain refinement effect even if Comparative Examples 4 and 5 and Examples 1 to 4 were very similar to one another in terms of the addition of the manganese and the injection of the carbon dioxide during the preparation process of the refiners, and the reason for this seems to be due to the fact that the second phases of the refiners according to Comparative Examples 4 and 5 were mainly composed of the gray phase having a composition of $Al_{5.5-6.5}Mn$ instead of the bright phase having a composition of $Al_{4-4.5}Mn$.

From the above results, it may be understood that a good grain refinement effect may be obtained when a refiner including the second phase structure according to Examples 1 to 4 of the present invention in the microstructure was used in a molten magnesium alloy.

The invention claimed is:

1. A refiner for a magnesium alloy, the refiner comprising:

5 wt % to 15 wt % of manganese (Mn), and aluminum (Al) as well as unavoidable impurities as a remainder;

wherein the refiner comprises:

an aluminum-based matrix; and a second phase consisting of a compound of aluminum (Al) and manganese (Mn) inside the aluminum-based matrix, wherein, in the second phase, an area of a compound having an Al/Mn compositional atomic ratio of 4 to 4.5 is greater than an area of a compound having an Al/Mn compositional atomic ratio of 5.5 to 6.5.

2. The refiner of claim 1, wherein, in the compound of Al and Mn, the area fraction of the compound having an Al/Mn compositional atomic ratio of 4 to 4.5 is 50% or more.

3. The refiner of claim 1, wherein, in the compound of Al and Mn, the area fraction of the compound having an Al/Mn compositional atomic ratio of 4 to 4.5 is 70% or more, and wherein the area fraction of the compound having an Al/Mn compositional atomic ratio of 5.5 to 6.5 is 30% or less.

4. The refiner of claim 1, wherein at least one of a flat interface and an acicular interface is formed between the second phase and the aluminum-based matrix.

5. The refiner of claim 1, further comprising 1 wt % or less of carbon (C).

6. The refiner of claim 1, wherein an area fraction occupied by the second phase in the aluminum-based matrix is 5% or more.

7. A method of manufacturing a magnesium alloy, the method comprising:

preparing a molten magnesium alloy by applying a protective gas to a magnesium alloy and heating the magnesium alloy to a melting temperature of the magnesium alloy to melt the magnesium alloy;

adding the refiner of claim 1 to the molten magnesium alloy and maintaining and stirring for 5 minutes to 2 hours; and casting the molten magnesium alloy having the refiner added thereto to manufacture a magnesium alloy casting material.

8. The method of claim 7, wherein the refiner is added as a solid phase or a liquid phase.

* * * * *